US007386988B1

(12) United States Patent
Petschauer

(10) Patent No.: US 7,386,988 B1
(45) Date of Patent: Jun. 17, 2008

(54) OUTSIDE TEMPERATURE HUMIDITY COMPENSATION SYSTEM

(76) Inventor: Richard J. Petschauer, 7520 Cahill Rd., #114, Edina, MN (US) 55439

( * ) Notice: Subject to any disclaimer, the term of this patent is extended or adjusted under 35 U.S.C. 154(b) by 334 days.

(21) Appl. No.: 10/796,516

(22) Filed: Mar. 9, 2004

(51) Int. Cl.
*F25B 49/00* (2006.01)
*B01F 3/02* (2006.01)

(52) U.S. Cl. ..... 62/176.6; 62/176.1; 236/44 R

(58) Field of Classification Search ..... 62/176.1, 62/92, 93, 176.6; 236/44 R, 44 E, 91 R, 236/91 C
See application file for complete search history.

(56) References Cited

U.S. PATENT DOCUMENTS 3,118,601 A * 1/1964 Robb, Jr. ..... 236/44 R
3,580,501 A * 5/1971 Streed ..... 236/44 C
4,248,051 A * 2/1981 Darcy et al. ..... 62/115
4,465,229 A * 8/1984 Kompelien ..... 236/44 E
4,889,280 A * 12/1989 Grald et al. ..... 236/44 C
4,911,357 A * 3/1990 Kitamura ..... 236/44 E
5,259,553 A * 11/1993 Shyu ..... 236/49.3
5,426,951 A * 6/1995 Yamashita et al. ..... 62/176.6
5,578,753 A * 11/1996 Weiss et al. ..... 73/355.02
6,035,649 A * 3/2000 Straub et al. ..... 62/93
6,161,763 A * 12/2000 Reuter ..... 236/44 C
6,295,823 B1 * 10/2001 Odom et al. ..... 62/176.6
6,557,771 B2 * 5/2003 Shah ..... 236/44 C

* cited by examiner

*Primary Examiner*—Chen-Wen Jiang
(74) *Attorney, Agent, or Firm*—Charles A. Johnson

(57) ABSTRACT

A humidity control system having an outside temperature humidity compensator circuit responsively coupled to an outside temperature sensing circuit and capable of responding to sensed inside humidity levels to provide control signals to a humidity controller to automatically adjust the target in-room humidity produced by a controller as a function of sensed changes in outside temperature is described. The compensator circuit provides two variables to allow control of both the level of humidity at a specified temperature and the rate of humidity change with changes in outside temperature, and provides a means to limit the highest humidity level that is independent of the controlling variables. Switching is shown to allow the compensator circuit to be switched out of operation and to allow it to be momentarily bypassed.

16 Claims, 5 Drawing Sheets

EFFECTIVE HUMIDITY SETPOINT VS. OUTSIDE TEMPERATURE

OUTSIDE TEMPERATURE HUMIDITY COMPENSATION SYSTEM

FIELD OF THE INVENTION

This invention pertains generally to controlling humidity, and more particularly to controlling humidity in a room where excess humidity causes undesired condensation. More particularly, the invention relates to a system and method to compensate for outside temperature changes in maintaining inside humidity.

BACKGROUND OF THE INVENTION

It is well known that humidity is important to comfort within any given environment. Many systems have been developed to adjust humidity levels in an enclosure, either by adding moisture to the air or removing moisture for given temperature conditions. The majority of prior art systems are involved with controlling the 'relative humidity' as opposed to the actual 'humidity', even though the literature relating thereto is generally expressed simply in terms of 'humidity'.

The term 'absolute humidity' is an expression of the actual amount of water vapor present in the air, and is usually expressed in terms of a humidity ratio, or pounds of water vapor per pound of dry air. 'Dewpoint' and 'absolute humidity' are related in that they both relate to the total amount of water in the air. As is known, 'dewpoint' is the temperature at which air become totally saturated, such that moisture condenses. For each value of 'absolute humidity' there is a single related value of 'dewpoint'. Unless water is added or taken away, the 'absolute humidity' and the 'dewpoint' remain the same, even though the temperature of the air changes.

The amount of moisture that is in the air, when compared to the maximum amount of moisture it can hold at a given temperature, is referred to as 'relative humidity'. As noted, this is the relationship that is generally cited as 'humidity' when literature or people refer to humidity-related numbers. Unless otherwise qualified, the term 'humidity' will be utilized in hereinafter in the general usage sense to indicate relative humidity.

It is of course well-known that warm air can hold more moisture than can cold air, and that the 'relative humidity' changes with changes in temperature, even though no moisture is added or removed. If a humidity control system maintains a constant humidity as temperature rises, a substantial amount of additional moisture will be held in the air. Though it would be desirable to maintain dewpoint at around 50° from a comfort standpoint, cold outside temperature may make this undesirable due formation of condensation on windows or wall structures. Problems can occur when comfortable indoor humidity levels are maintained during cold weather. Moisture will usually first condense on windows because they have less insulation capability than walls, that is, the temperature on the inside surface may be lower than the dewpoint of the inside air.

The American Association of Heating and Refrigeration Engineers recommends maintaining humidity levels for indoor swimming pools and spas in the range of 50% to 60% to provide the most desirable for comfort. It also recommends that the building enclosure be designed to handle these levels to avoid damage from condensation, frost build-up, and moisture penetration. In geographical areas with cold winter climates, this ideal cannot always be met. In some buildings and conditions, it is necessary or desirable to adjust the humidity levels as the outside temperature changes so as to avoid or minimize damage to the structure.

Some manufacturers have recognized and provided equipment that addresses the humidity concerns in residential structures. For example, one supplier has marketed a system for residential humidification, but not dehumidification, as a function of outside temperature. However, the ranges of humidity control for that system are too low for swimming pool or spa applications, and merely function as on-off control, not proportional control. Another manufacturer has marketed a residential system that calculates and adjusts dewpoint, but again, the ranges of control are insufficient for use in swimming pool applications.

While simply reducing the humidity within the building can have a positive result in lowering the damages mentioned above, there is cost factor in such reduction. For example, reducing the humidity in a pool or spa structure causes the rate of evaporation to increase. This increases the cost to remove the additional water vapor. For example, in a typical indoor pool, reducing the indoor humidity for 55% to 35% increases the evaporation rate by about 30%. Energy costs to control this higher level of humidity reduction (removal of additional moisture) will usually increase by a similar rate. Prior art humidity control systems adapted for use in pool or spa enclosures have been of fixed setting variety that either maintain humidity at fixed levels based upon inside temperature, or require manual re-setting to account for temperature changes. Such manual intervention results in inefficient energy usage and is difficult to maintain on regular basis to account for temperature changes from daytime to nighttime conditions.

Rather than maintaining humidity at a fixed rate, with the attendant additional costs, or attempting to manually adjust humidity targets, it would be preferable to adjust the inside humidity change as a function of the inside humidity and the outside temperature.

SUMMARY OF THE INVENTION

The present invention relates to a system for varying indoor humidity with respect to changes in outside temperature and the level of the indoor humidity.

One embodiment of the invention provides an improved humidity control system for use in extreme environments, such as swimming pool structure or the like, and includes an inside humidity sensor, a humidity controller having a selectively actuatable humidity level selection control for selecting a target in-room humidity, and an outside temperature circuit that changes its condition in response to changes in the outside temperature, and an outside temperature humidity compensator circuit that responds to the inside humidity sensor and the outside temperature circuit to automatically adjust the target in-room humidity produced by the humidity controller.

Another embodiment of the invention provides an outside temperature humidity compensator circuit that can respond to measured humidity levels and changes in outside temperature to automatically provide output signals for use in controlling adjustment of target in-room humidity.

Yet another embodiment of the invention provides two variables to control both a target level of humidity at a selected outside temperature and the rate of humidity change with changes in outside temperature.

Still another embodiment of the invention provides a means to limit the highest humidity level that is independent of the two controlling variables.

Yet another embodiment of the invention includes a first switching mechanism for switching the outside temperature humidity compensating circuit out of operation in a humidity controlling system, and a second switching mechanism for momentarily bypassing the compensating circuit.

Another embodiment of the invention is an outside temperature humidity compensating system that includes receiving means for receiving indications of changes in outside temperature; humidity receiving means for receiving humidity signals indicative of the in-room humidity; reducing means for reducing received humidity signals by a selectable predetermined amount and providing reduced humidity signals; adjusting means for providing adjusting signals in response to received indications of changes in outside temperature; and outputting means for providing output signals in response to the adjusting signals and the reduced humidity signals, whereby the output signals can be utilized to control a humidity controller.

A further embodiment of the invention is a method for compensating control of indoor humidity in response to changes in outside temperature that includes reducing signals indicative of sensed in-door humidity by selectable levels of reduction; sensing changes in outside temperature and developing adjusting signals indicative of the changes; and combing the reducing signals and the adjusting signals to provide output signal for use in controlling the operation of a humidity controller.

The present invention is thus an improved outside temperature dependant humidity control system for automatically adjusting the target in-room humidity produced by a humidity controller in response to variations in outside temperature.

Additional features and aspects of the invention and the advantages derived therefrom, and the various scopes and aspects of the invention will become apparent from the drawings, the description of the preferred embodiments of the invention, and the appended claims.

DESCRIPTION OF THE PREFERRED EMBODIMENTS

Figure 1:
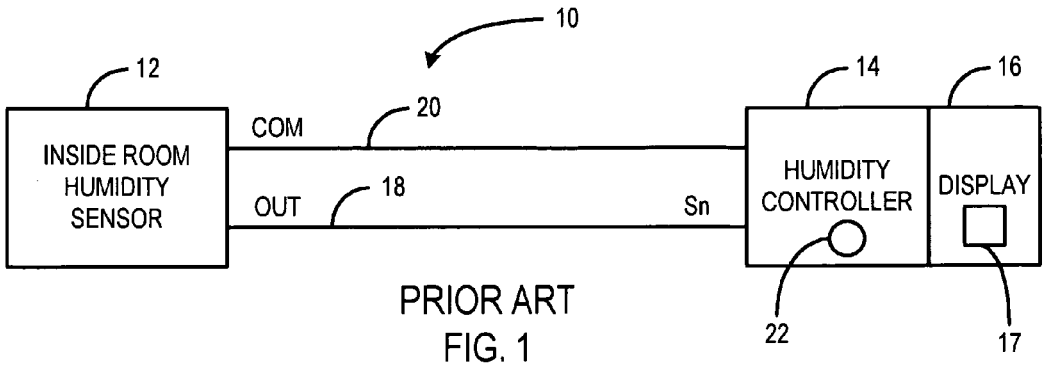
PRIOR ART FIG. 1
FIG. 1 is a simplified block diagram of a Prior Art humidity sensing and controlling system.

When referring to the drawings, like reference numerals will denote like elements throughout the various views.

FIG. 1 is a simplified block diagram of a Prior Art humidity sensing and controlling system.

In the Prior Art, an example humidity sensing and controlling system 10 includes an inside room humidity sensor 12 and a humidity controller 14, which can have an associated display 16, with a selectively actuatable display screen 17. An illustrative inside room humidity sensor 12 can be a model HE-67 humidity sensor transmitter available from Johnson Controls, Inc., or similar, and functions to sense humidity levels within a room, such as a swimming pool enclosure, and to provide humidity level indicating voltage levels on line 18 to terminal Sn on humidity controller 14. A circuit common connection, labeled COM, is provided on line 20.

A humidity controller 14 can be a model W351 or W351P, the latter providing proportional functionality, available from Johnson Controls, Inc., or similar, and generally functions to provide control signals to associated humidification and/or dehumidification controls (not shown). Humidity controller 14 includes a manually adjustable control 22 for setting the adjustable setpoint, where the range can be selected from 10% to 90% humidity, and would normally be the target desired humidity level for environment. The setpoint adjustments will be discussed in more detail below. Controller 14 operates on 24 VAC/VDC, and provides two simultaneous analogue outputs of 0 to 10 VDC and 0 to 20 mA.

It is of course apparent that the humidity sensing and controlling system 10 operates within an enclosed environment, and is limited to adjusting humidity levels at the prevailing interior temperatures. As noted above, such limited control capability can be insufficient in severe environments, such as enclosed swimming pools or spas, and in climatic regions where the outside temperature can differ in significant degrees from the inside temperature.

Figure 2:
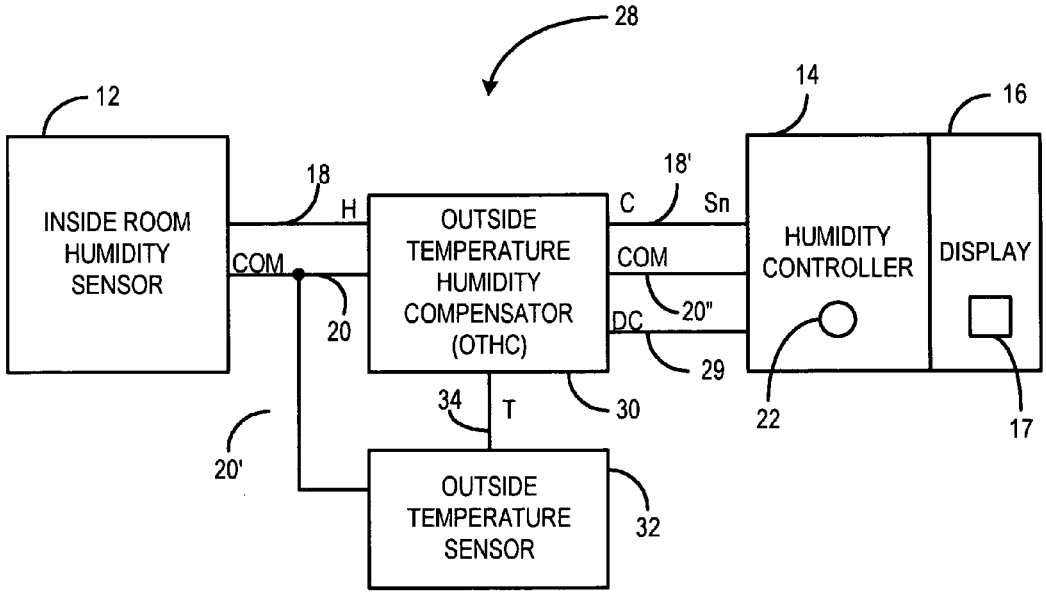
FIG. 2 is a block diagram of an outside temperature dependant humidity control system of this invention.

FIG. 2 is a block diagram of an outside temperature dependant humidity control system of this invention.

The outside temperature dependant humidity control system 28 includes inside room humidity sensor 12 and humidity controller 14, a source of DC voltage provided on line 29, and with outside temperature humidity compensator 30, hereinafter referred to as OTHC, coupled to receive the output of sensor 12 on line 18 at terminal H, and the circuit common COM connection on line 20. The OTHC is coupled to respond to the outside temperature sensor 32, which is coupled via line 34 to terminal T and via COM line 20'. Outside temperature sensor 32 can be any circuit capable of sensing changes of outside temperature and providing a capability to interact in a circuit in a manner to indicate such temperature changes. In the preferred embodiment the temperature sensor 32 is a thermistor. The OTHC combines the input from the inside room humidity sensor 12 with the indication of outside temperature change to provide an output signal at terminal C to line 18' to the Sn terminal of humidity controller 14 and the COM connection is provided via line 20". As will be described in more detail below, the OTHC output signal is derived from the output signal of the inside room humidity sensor 12 based upon sensed changes in outside temperature. This requires that the setpoint of humidity controller 14 be adjusted such that the modified control signal will cause controller 14 to adjust humidity in response to outside temperature changes and will control the rate of humidity adjustment based upon the rate of outside temperature change.

When the OTHC 30 is activated, the OTHC intercepts the sensor 12 output and modifies it according to the outside temperature and then retransmits it to controller 14. Since this modification reduces the humidity sensor 12 output voltage before it is sent to controller 14, the controller setpoint must be reduced from its normal setting, as will be described in more detail below. The reduced setpoint then remains fixed, but an 'effective humidity setpoint' is created that is higher than that of controller 14 by an amount that varies with the outside temperature. A potentiometer acts as a 'rate' adjustment device, as will be described in more detail below, in the compensation network and adjusts how much the effective humidity setpoint changes for a given change in outside temperature. Typical values range from about 2% to 5% change in relative humidity for each 10 degrees F. change in temperature. The OTHC also has an upper humidity setpoint limit of approximately 60% relative humidity. Usually this will allow the system to function in summer outside temperature without excess humidity or the need to turn the OTHC off.

Figure 3:
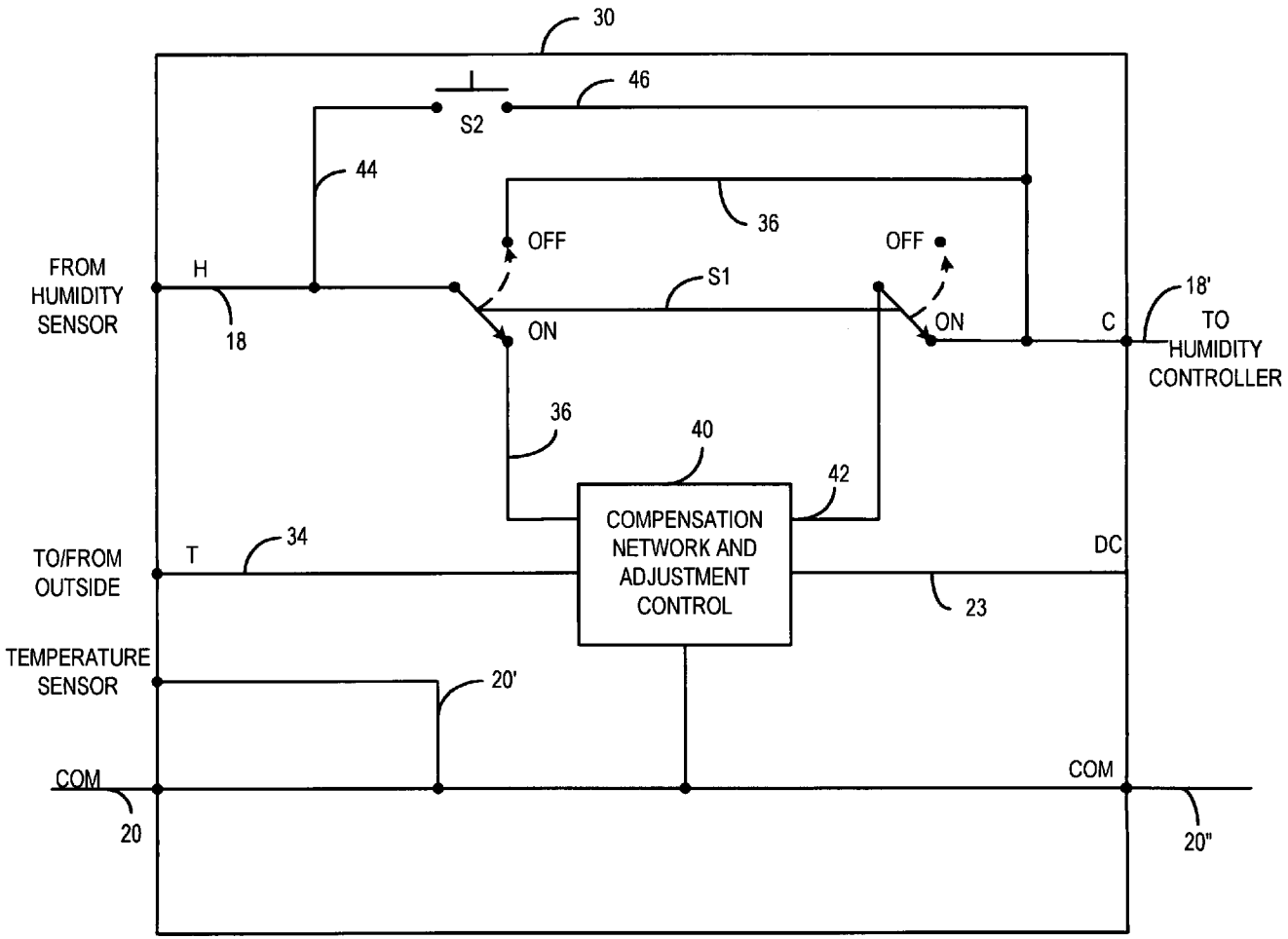
FIG. 3 is a block diagram of an outside temperature humidity compensator with control switching.

FIG. 3 is a block diagram of an outside temperature humidity compensator with control switching.

This block diagram illustrates the switching capability of an embodiment of the invention whereby the OTHC 30 can be switched in or out of operation, or can be momentarily bypassed for purposes of adjustment or for allowing selected readouts.

In this embodiment switch S1 functions as an on-off selection, and comprises a double-pole double-through arrangement. When S1 is switched to the OFF position, the signal from sensor 12 is passed from input line 18, through the S1 OFF contact via line 36, such that the input signal passes directly to output terminal C. This allows the system to function without the OTHC function being involved. For operation this way, the controller 14 setpoint control 22 would then be reset to its normal position. When switch S1 is moved to the ON position, the input signal provided on line 18 passes through the switch contact and via line 38 as an input signal for the compensation network & adjustment control circuit 40.

Circuit 40 is coupled to the outside temperature sensor through terminal T via line 34, and can be coupled to a source of DC power (not shown) via line 23. When engaged, circuit 40 utilizes the sensor 12 input signal applied on line 36 and the outside temperature condition provided on line 34 to provide an output signal on lines 42 and 18'. This output signal, in conjunction with the setpoint of controller 14, provides control of the humidity controller 14 such that its operation is modified by outside temperature changes.

In this embodiment circuit 40 can be operational and selected to be ON via switch S1, but can be momentarily bypassed for purposes of testing, making adjustment, obtaining readouts, or the like. The bypass function is accomplished by depressing normally open switch S2, thereby passing the input signal received on line 18 through line 44 and through switch S2 via line 46 to output terminal C.

It is of course understood that either or both of switches S1 and S2, and their related functionality can be eliminated. In the event both S1 and S2 are eliminated, the compensation network & adjustment control circuit 40 would become the OTHC 30, in that circuit 40 performs the compensation adjustment responsive to sensed changes in outside temperature. The manner and selection of the setpoint adjustments, in conjunction with the with the output of control circuit 40, to achieve desired humidity and rates of adjustment in response to changes in outside temperature, will described in more detail below.

Figure 4:
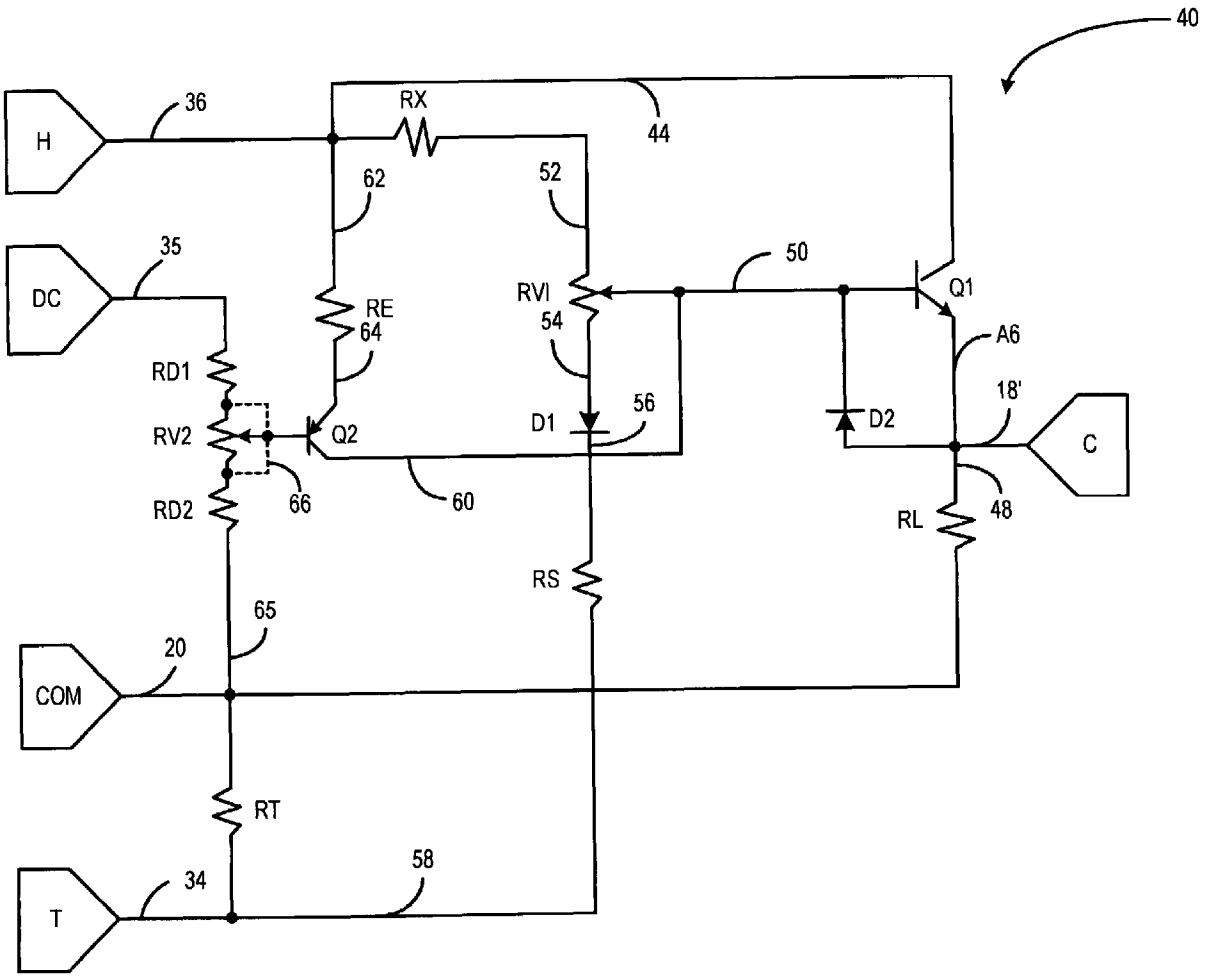
FIG. 4 is a circuit schematic diagram of a compensation network and adjustment control circuit.

FIG. 4 is a circuit schematic diagram of a compensation network and adjustment control circuit.

Circuit 40 is an embodiment of the compensation network & adjustment control circuitry described in FIG. 3; and, as indicated above, comprises the OTHC 30 when switches S1 and S2 are not utilized. The circuit includes a first transistor Q1 having a first element, in this instance its collector, coupled via lines 44 and 36 to terminal H, which is adapted to receive input from the inside humidity sensor 12. Transistor Q1 has a second element, in this case its emitter, coupled via lines 46 and 48 through load resistor RL to COM via line 20. The second element is also coupled via lines 46 and 18' to terminal C, which is adapted to provide control signals to the humidity controller 14. Transistor Q1 has a third element, its base, coupled via line 50 to the wiper element of variable resistor RV1. A first resistor RX is coupled to terminal H via line 36 and to variable resistor RV1 via line 52. Diode D1 is coupled via line 54 to variable resistor RV1. D1 is coupled via line 56 to a second resistor RS. RS is coupled via lines 58 and 34 to terminal T. In this arrangement transistor Q1 is operable as an emitter follower. Variable resistor RV1 functions as a rate adjuster and adjusts how much the effective humidity setpoint changes for a given change in outside temperature. Diode D2 is coupled across C terminal and the base of Q1, and is not needed for functional operation of the OTHC 30. Diode D2 is utilized to protect transistor Q1 in case a large voltage that above the reverse emitter-base breakdown voltage is inadvertently applied at terminal C.

Transistor Q2 has a fourth element, in this embodiment its collector, coupled via lines 60 and 50 to the third element of Q1, a fifth element, in this embodiment its emitter, and a sixth element, in this embodiment its base. A third resistor RE is coupled via lines 62 and 36 to terminal H and is coupled via line 64 to the fifth element of Q2. A fourth resistor RD1 is coupled to terminal DC for coupling to a source of DC voltage (not shown). In a preferred embodiment a 12 VDC source would be utilized. A fifth resistor RD2 is coupled via lines 65 and 20 the COM terminal. In a fixed bridge connection resistors RD1 and RD2 are coupled together via line 66 and are coupled to base of Q2. In an alternative adjustable bridge configuration variable resistor RV2 is coupled intermediate resistors RD1 and RD2, with its wiper coupled to the base of Q2.

The outside temperature sensor in one embodiment of the invention is comprised of thermistor RT, which is coupled across the terminal T and the COM terminal. Thermistor RT has a negative temperature coefficient such that its resistance decreases as temperature increases. The thermistor RT is a part of the bridge network that establishes the bias at the base of Q1. The variation in resistance value of RT affects bridge network, thereby controlling the bias on Q1. Table 3 illustrates the voltage ratios of the voltages of line 18' divided by the voltage on line 36 and thermistor values at various outside temperatures

TABLE 1

VOLTAGE RATIOS AND THERMISTOR VALUES vs. OUTSIDE TEMPERATURE

| TOUT (F.°) | MIN. RATE | MAX. RATE | T (K) |
|---|---|---|---|
| −20 | 1.15-1.22 | 1.31-1.36 | 37.1 |
| −15 | 1.17-1.24 | 1.36-1.42 | 31.3 |
| −10 | 1.20-1.27 | 1.42-1.48 | 26.5 |
| −5 | 1.23-1.30 | 1.50-1.56 | 22.5 |
| 0 | 1.26-1.33 | 1.58-1.64 | 19.2 |
| 5 | 1.29-1.36 | 1.67-1.74 | 16.4 |
| 10 | 1.33-1.40 | 1.77-1.84 | 14.1 |
| 15 | 1.36-1.44 | 1.89-1.96 | 12.1 |
| 20 | 1.40-1.48 | 2.02-2.10 | 10.4 |
| 25 | 1.44-1.52 | 2.16-2.25 | 8.99 |
| 30 | 1.48-1.56 | 2.32-2.41 | 7.78 |
| 35 | 1.52-1.60 | 2.50-2.60 | 6.76 |
| 40 | 1.56-1.64 | 2.69-2.79 | 5.88 |
| 45 | 1.59-1.68 | 2.89-3.01 | 5.13 |

TABLE 1-continued

| VOLTAGE RATIOS AND THERMISTOR VALUES vs. OUTSIDE TEMPERATURE | | | |
|---|---|---|---|
| TOUT (F.°) | MIN. RATE | MAX. RATE | T (K) |
| 50 | 1.63-1.72 | 3.11-3.24 | 4.48 |
| 55 | 1.67-1.75 | 3.35-3.49 | 3.93 |

Though it is recognized that a variety of component values and selections for differing power supply levels and for differing input and output voltage signal requirements for other embodiments of the invention, the components and component values set forth in Table 2 can be utilized for a preferred embodiment. The component values and selections are illustrative only, and do not limit the scope of the invention.

TABLE 2

| Symbols and Components | |
|---|---|
| D1 & D2 | Silicon Diodes |
| Q1 | NTE 152 NPN |
| Q2 | NTE 153 PNP |
| RD1 | 68K (fixed bridge) 50k (adjustable) |
| RD2 | 56K (fixed bridge) 50k (adjustable) |
| RE | 1K resistor |
| RS | 1K resistor |
| RL | 39K resistor |
| RX | 6.8K resistor |
| RV1 | 5K potentiometer |
| RV2 | 1k potentiometer |
| RT | Thermistor |
| DC | 12 volts dc |
| COM | Circuit Common Connection |
| H | From Inside Humidity Sensor |
| T | Test Point - Outside Sensor |
| C | To Humidity Controller |
| S1 | Switch - DP/DT |
| S2 | Switch - Normally Open Push |

OTHC Operation

Having described the circuit arrangement of the OTHC, its operation will be described. The sensor 12 output signal is an analog dc voltage proportional to the humidity of the room being controlled, with a voltage range of 0 to 10 VDC corresponding to a humidity range of 0% to 100%. This voltage output is measured from the COM terminal to terminal H at the input to the OTHC, and in operation this signal passes through the voltage dividing network of the series combination of resistor RX, the rate potentiometer RV1, diode D1, resistor RS, and thermistor RT, and finally to COM. Based upon the position of the wiper contact of RV1, a fraction of the voltage is applied to the base of transistor Q1. Transistor Q1 is connected as an emitter follower, which thereby passes the signal, reduced or shifted down by a value equal to the base-emitter voltage drop of transistor Q1, to output terminal C, which in turn can be connected to humidity controller 14.

Controller 14, based upon well known feedback control system properties, attempts to adjust the humidity of the room so that the signal it receives at its input C is close to the value of the controller 14 setpoint that a user has selected by its control selector 22 or by other means provided by the controller. In this case since voltage signal from sensor 12 has been lowered, the room humidity will be controlled to a value above the reduced setpoint. For example if the voltage at C is one-half of that at H, the room humidity will be controlled a value of two times that of the controller 14 setpoint. The voltage dividing ratio will vary with the position of the wiper of potentiometer RV1 and the resistance of thermistor RT, which is located outside and whose resistance varies with temperature with a negative temperature coefficient, such that its resistance decreases as temperature rises. At higher temperature and for a given voltage input at terminal H, there will be more current going through the voltage dividing network, thereby yielding a larger voltage drop at the base of Q1. This means that the room humidity must rise in order to produce the same voltage at the output terminal C and at the controller 14 input and to satisfy the controller. It should also be noted that for a fixed temperature and value of RT, varying the setting of potentiometer RV1 will also change the voltage division; and, hence the room humidity value that will produce a signal at terminal C that equals the controller setpoint.

The transistor Q2 provides a clamp circuit to limit the humidity rise above a value of approximately 60%. In the fixed voltage divider arrangement (RV2 not used), divider resistors RD1 and RD2 drop the 12 volt input to about one Q2 base-emitter voltage less than 6 volts. Thus, when the input voltage at terminal H is applied through resistor RE to Q2 rises above 6 volts, Q2 begins to conduct. The 6 volt level corresponds to about 60% humidity. The output of Q2 is applied to Q1, and when conducting, raises the voltage at the base of Q1. As noted, Q1 operates as an emitter follower and thereby raises the voltage at terminal C. This then causes controller 14 to attempt to reduce humidity. Differing values of RD1 and RD2 will allow establishing different humidity limits.

In the alternative embodiment of the voltage divider, potentiometer RV2 allows a range of adjustment of the bias to Q2, such that drift, variations in tolerances of the various equipment and components, aging and/or degradation of equipment function, and the like, can be off-set.

Settings

By applying simple dc equations, voltage dividing ratios for various combinations of outside temperatures and potentiometer positions can be developed or modeled, thereby providing the basis for development of a table of humidity variations versus temperature range for various combinations of controller setpoints and potentiometer RV1 settings.

Based upon these calculations Table 3 sets forth a table of humidity variations vs. temperature variations for various combinations of controller setpoints and potentiometer RV1 settings. To utilize Table 3, a target humidity level H0, for an outside temperature of 0° F. is estimated. Referring to the first column, select the proper row in Table 3 that represents the number of degrees of outside temperature change and select the proper column that represents % humidity rise for the increased outside temperature. Where the selected row and column intersect, the settings for the controller 14 setpoint control 22 and the OTHC 30 rate setting for RV1 will be shown.

TABLE 3

| Controller Setpoint/Rate Setting Table | | | | | | | | |
|---|---|---|---|---|---|---|---|---|
| | Humidity % Rise from 0 F. to 40 F. | | | | | | | |
| H0 | 8 | 10 | 12 | 14 | 16 | 18 | 20 | 22 |
| 26 | 14/47 | 14/62 | 13/82 | 13/94 | 13/99 | NA | NA | NA |
| 28 | 16/35 | 15/58 | 15/72 | 14/89 | 14/98 | NA | NA | NA |
| 30 | 18/27 | 17/48 | 16/67 | 16/78 | 15/93 | 15/99 | NA | NA |

TABLE 3-continued

| Controller Setpoint/Rate Setting Table | | | | | | | | |
|---|---|---|---|---|---|---|---|---|
| | Humidity % Rise from 0 F. to 40 F. | | | | | | | |
| H0 | 8 | 10 | 12 | 14 | 16 | 18 | 20 | 22 |
| 32 | 19/24 | 19/40 | 18/59 | 17/75 | 17/84 | 16/98 | NA | NA |
| 34 | 21/16 | 20/37 | 19/55 | 19/66 | 18/80 | 18/89 | 17/99 | NA |
| 36 | 23/9 | 22/29 | 21/49 | 20/63 | 20/72 | 19/85 | 19/93 | 19/99 |
| 38 | 25/2 | 24/22 | 23/39 | 22/55 | 21/69 | 21/77 | 20/89 | 20/96 |
| 40 | 26/1 | 26/15 | 25/33 | 24/48 | 23/62 | 23/71 | 22/82 | NA |
| 42 | 28/1 | 27/14 | 26/31 | 25/47 | 25/56 | 24/70 | 22/99 | * |
| 44 | 29/0 | 29/10 | 28/25 | 27/41 | 26/58 | 23/99 | * | * |
| 46 | NA | 31/3 | 30/19 | 28/49 | 25/92 | * | * | * |

(H0 = Target Humidity for 0 F. See Column 1)
NA = Not Available
* Maximum humidity is appropriately 62%

An example calculation can be established for a target humidity level H0, for an outside temperature of 0° F. In the example calculation—

Desired humidity at 0° F. is 40% and at 40° F. is 56%

H0=40%

% Rise at 40° F.=56−40=16

From the Table 3 Entries Select the Settings

Controller setpoint=23

Rate setting=62

It can be seen, then, that the combined settings for controller 14 and OTHC control RV1, allow controlled operation of the system to accommodate changes in outside temperature.

Figure 5:
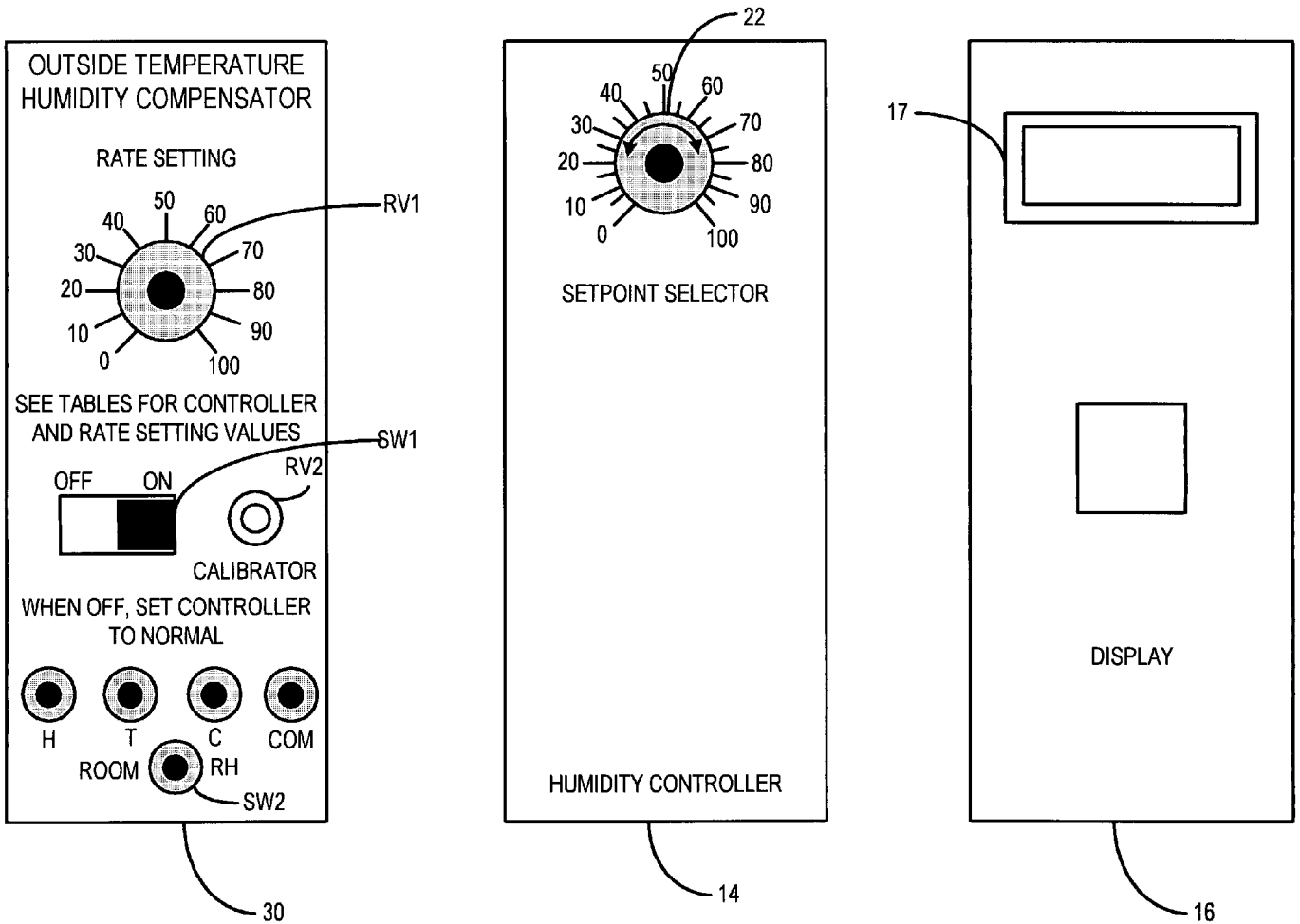
FIG. 5 is a face view on a control panel of an outside temperature humidity compensator and the control panels of associated humidity controller and display units.

FIG. 5 is a face view of a control panel of an outside temperature humidity compensator and the control panels of associated humidity controller and display units.

When the OTHC 30 is ON, display 16 will not display the actual room humidity level at its visual display 17, but it will display the controller 14 input at terminal C. To view the room humidity, S2 may be depressed to temporarily bypass the OTHC and connect the sensor 12 output to controller 14 input terminal C, thereby allowing the room humidity to be displayed at display 17. To avoid response of controller 14 to this change of input, S2 must not be held engaged for more than a few seconds at a time.

The terminals H, T, C, and COM are all brought out to the face plate of OTHC 30 for ease of metering, trouble shooting, system evaluation, and the like.

Figure 6:
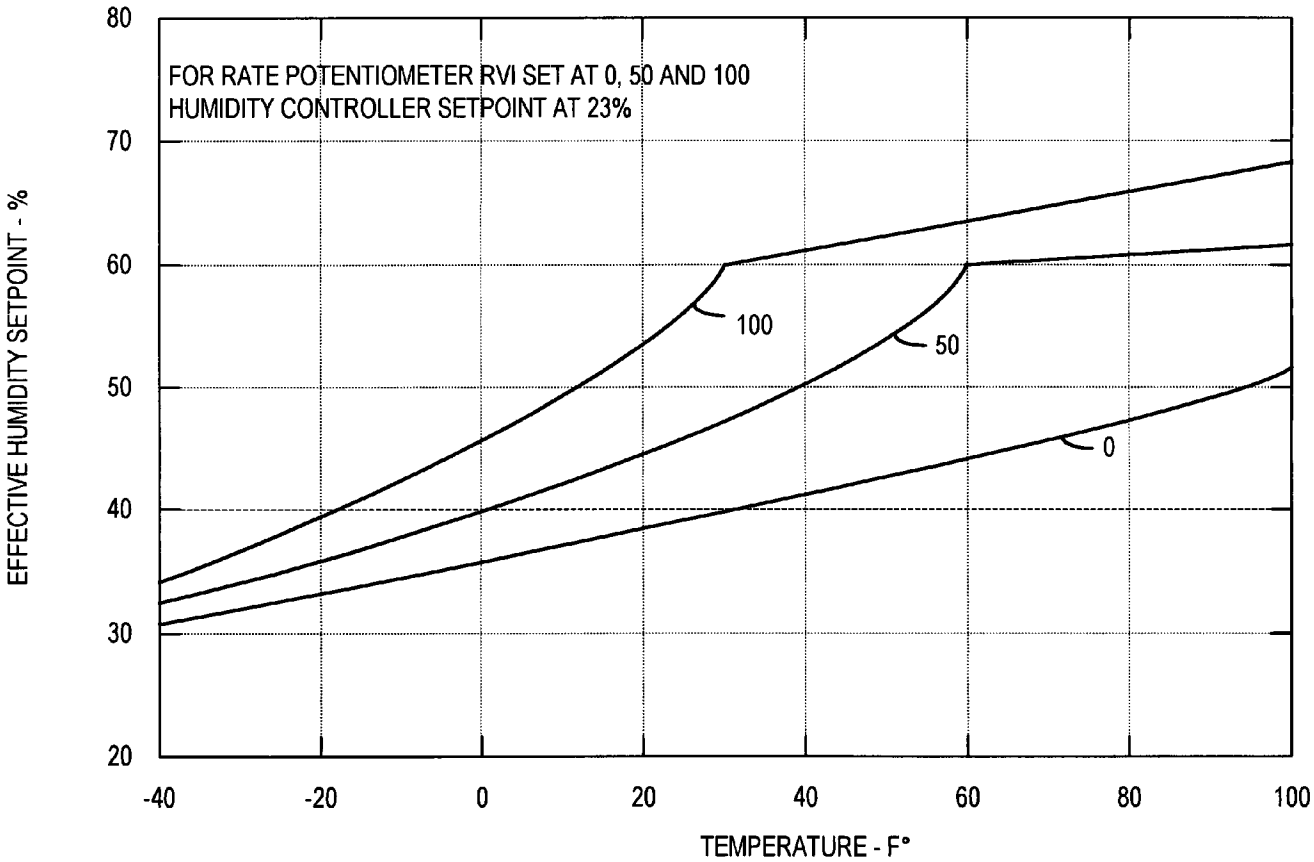
FIG. 6 is a plot of example rate settings for an outside temperature humidity compensator in conjunction with an example setpoint for an associated humidity controller, and illustrates the slope of effective humidity changes in response to changes in outside temperature.

FIG. 6 is a plot of example rate settings for an outside temperature humidity compensator in conjunction with an example setpoint for an associated humidity controller 14, and illustrates the slope of effective humidity change in response to changes in outside temperature. These illustrative plots illustrate how the effective relative setpoint varies with the outside temperature with the rate potentiometer RV1 set at its midpoint and at the two end extreme positions and with the control 14 setpoint control 22 set at 23% humidity. It should be noted that the rate of humidity rise above 60% is greatly reduced because of the clamping action of transistor Q2.

In view of the foregoing descriptions, then, it can be seen that the various embodiments of the invention have achieved a number of goals. The OTHC has been shown that it can be utilized within a total system, or that it can be supplied as a stand-alone unit that can be added on to existing humidification control systems. Further, it is compatible with on/off or proportional control systems. The novel functionality of the OTHC includes and provides two variables to control both the level of humidity at a specified temperature and the rate of humidity change with temperature change. A Table of control setting selections provides a simple means for selecting the variable settings. The system provides a means to limit the highest humidity level that is independent of the two controlling variables, and such limit can be adjusted. The ability to switch the OTHC in and out of interaction with a humidity sensor and a humidity controller allows for alternative summer operation and/or to aid in trouble shooting of the system. The ability to provide a momentary removal of the OTHC output to a humidity controller allows the humidity level to be displayed. The OTHC is durable, reliable, and constructed from commercially available components.

The actual room humidity may be somewhat higher than the effective humidity as a function of controller 14 error or offset. For proportional control systems, if a throttling range adjustment is available, it is preferable that this adjustment be reduced to about one-half of its normal setting value, since the OTHC reduces the gain of the feedback system.

Numerous characteristics and advantages of the invention have been set forth. It is understood that the description of the preferred embodiments are, in many respects, only illustrative. Changes may be made in details, particularly in matters of component selection and matters of shape, size, and arrangement of parts, without exceeding the scope of the invention. Having described the preferred embodiments in conjunction with the drawings, it can be seen that the various purposes and objectives have been achieved, and that there may be modifications and extensions that will become apparent to those skilled in the art without exceeding the spirit and scope of the invention. Accordingly, what is intended to protected by Letters Patent is set forth in the appended Claims.

What is claimed is:

1. A humidity control system comprising:

an inside room humidity sensor;

a humidity controller coupled to said inside humidity sensor, said humidity controller having a selectively actuatable humidity level selection control for providing a control signal for selecting a target in-room humidity;

an outside temperature sensor circuit; and an outside temperature humidity compensator circuit responsively coupled to said outside temperature sensor circuit and to said humidity controller for selectively altering said control signal, wherein said outside temperature humidity compensator circuit includes a compensation network including said outside temperature sensing circuit, and an adjustment control circuit, a control switch having a first switch position to select coupling said inside room humidity sensor directly to said humidity controller and having a second switch position to couple said compensation network and adjustment control circuit to said inside room humidity sensor and to said humidity controller;

whereby sensed outside temperature causes said outside temperature humidity compensator circuit to automatically adjust the target in-room humidity produced by said humidity controller.

2. A system as in claim 1 wherein said compensation network includes:

an input divider circuit including said outside sensor circuit; and a first compensating circuit coupled to said inside room humidity sensor and to said input divider circuit to provide a first variable bias signal level responsive to outside temperature sensed by said outside temperature sensor circuit.

3. A system as in claim 2, wherein said adjustment control circuit includes an output circuit coupled intermediate said inside room humidity sensor and said humidity controller, said output circuit also coupled to said first compensating circuit, said output circuit to provide an output signal to said humidity controller; and a selectively variable circuit coupled to said inside room humidity sensor, to said outside temperature sensor, and to said output circuit to provide a second variable bias signal level, whereby said output circuit provides said output signal determined by said outside temperature sensed and the setting of said selectively variable circuit.

4. A system as in claim 3, wherein said selectively variable circuit includes a first manually adjustable potentiometer.

5. A system as in claim 4, wherein said input divider circuit includes a second manually adjustable potentiometer to provide controlled calibration of said output signal.

6. A system as in claim 2, wherein said outside temperature sensor circuit includes a thermistor whose resistive value varies with changes in ambient temperature.

7. A humidity control system comprising:

an inside room humidity sensor;

a humidity controller coupled to said inside humidity sensor, said humidity controller having a selectively actuatable humidity level selection control for providing a control signal for selecting a target in-room humidity;

an outside temperature sensor circuit; and an outside temperature humidity compensator circuit responsively coupled to said outside temperature sensor circuit and to said humidity controller for selectively altering said control signal, wherein said outside humidity temperature compensator circuit comprises:

a circuit common connection;

a power input terminal for coupling to a source of power;

a temperature sensitive resistor having a first connection and a second connection coupled to said circuit common connection;

a first transistor having a first element coupled to said inside humidity sensor, a second element coupled to said humidity controller, and a third element;

a load resistor coupled between said second element and said circuit common connection;

a first variable resistor having a wiper element coupled to said third element;

a first resistor coupled intermediate said inside room humidity sensor and said first variable resistor;

a first diode having a first diode terminal and a second terminal, said first diode terminal coupled to said first variable resistor;

a second resistor coupled intermediate said second diode terminal and said first connection;

a second transistor having a fourth element coupled to said third element, a fifth element, and a sixth element;

a third resistor coupled intermediate said fifth element and said inside room humidity sensor;

a fourth resistor coupled intermediate said power input terminal and said sixth element; and a fifth resistor coupled intermediate said sixth element and said circuit common connection, whereby sensed outside temperature causes said outside temperature humidity compensator circuit to automatically adjust the target in-room humidity produced by said humidity controller.

8. A system as in claim 7, and further including a second diode coupled intermediate said second element and said third element.

9. A humidity adjusting method comprising:

providing selectively reduced signals indicative of sensed indoor humidity levels;

sensing changes in outside temperature and developing temperature controlled adjusting signals indicative of such changes;

combining the selectively reduced signals and the adjusting signals for providing output signals for use in controlling the operation of a humidity controller;

developing a source of setpoint settings and rate of humidity change settings for a predetermined range of outside temperatures and a predetermined range of percentage of humidity changes associated with changes in outside temperature; and selecting the setpoint setting and the rate of humidity change setting from the source of settings for a desired outside temperature range and a desired rate of humidity change.

10. For use in humidity control system having a selectively actuatable humidity level selection control for providing a control signal for selecting a target in-room humidity, an outside temperature humidity compensating system comprising:

receiving means for receiving indicators of changes in outside temperature;

humidity receiving means for receiving humidity signals indicative of the in-room humidity;

reducing means for reducing received humidity signals by a selectable predetermined amount and for providing reduced humidity signals;

adjusting means for providing adjusting signals for adjusting the control signal in response to received indications of changes in outside temperature; and outputting means for providing output signals in response to the adjusting signals and the reduced humidity signals, whereby the output signals can be utilized to control a humidity controller.

11. A system as in claim 10, wherein said reducing means includes:

rating means for permitting manual selectable settings for defining the rate of percentage of humidity change for a range of temperature changes.

12. A system as in claim 10, wherein said adjusting means includes:

voltage dividing means for shifting voltage levels in response to sensed changes in the outside temperature; and voltage adjusting means for providing the adjusting signals in response to changes in the voltage dividing means.

13. An outside temperature humidity compensation circuit comprising:

a first input circuit for receiving humidity signals from a humidity sensor;

a second input circuit for coupling to an outside temperature sensor circuit;

a first compensating circuit coupled to said first input circuit and said second input circuit to provide a first variable temperature compensating signals in response to changes in outside temperature;

an output circuit; and a selectively variable circuit coupled to said first input circuit, to said second input circuit, to said first compensating circuit, and to said output circuit to provide second variable signals to said output circuit, whereby said output circuit provides said second variable signals determined by changes in outside temperature and the setting of said selectively variable circuit.

14. The circuit of claim 13, and further including a thermistor coupled to said second input circuit.

15. A circuit as in claim 13, wherein said selectively variable circuit includes a manually adjustable potentiometer for adjusting the effective rate of percentage of humidity change.

16. The Circuit of claim 13, and further including a control switch coupled between said input circuit and said output circuit, whereby the compensation circuit can be switched active and inactive.

* * * * *